United States Patent [19]

Green

[11] Patent Number: 5,074,562

[45] Date of Patent: Dec. 24, 1991

[54] SPHERICAL MECHANICAL PUZZLE

[76] Inventor: Daniel E. Green, #1 Laughing Lake Dr., St. Louis, Mo. 63124

[21] Appl. No.: 699,517

[22] Filed: May 14, 1991

[51] Int. Cl.[5] ..... A63F 9/08

[52] U.S. Cl. ..... 273/153 S

[58] Field of Search ..... 273/153 S

[56] References Cited

U.S. PATENT DOCUMENTS

| | | | |
|---|---|---|---|
| 507,215 | 10/1893 | Churchill . | |
| 668,386 | 2/1901 | Moss | 273/153 S |
| 3,564,735 | 2/1971 | Fisher . | |
| 3,726,527 | 4/1973 | Schauffler . | |
| 4,452,454 | 6/1984 | Greene . | |
| 4,484,744 | 11/1984 | Gmünder | 273/153 S |
| 4,526,372 | 7/1985 | Kikis . | |
| 4,593,907 | 6/1986 | Abu-Shumays et al. . | |
| 4,625,967 | 12/1986 | Yu . | |
| 4,735,417 | 4/1988 | Gould | 273/153 S |
| 4,832,343 | 5/1989 | Bernat . | |
| 4,836,547 | 6/1989 | Krikheli . | |
| 4,856,786 | 8/1989 | Gyovai . | |
| 4,863,172 | 9/1989 | Rosenwinkel et al. . | |
| 4,865,323 | 9/1989 | Heusinkveld . | |
| 4,871,173 | 10/1989 | Lammertink . | |
| 4,872,682 | 10/1989 | Kuchimanchi et al. . | |
| 4,877,248 | 10/1989 | Farraj | 273/153 S |
| 4,877,406 | 10/1989 | Wilk . | |
| 4,889,340 | 12/1989 | Greene . | |
| 4,927,150 | 5/1990 | Monoyios . | |

FOREIGN PATENT DOCUMENTS

| | | | |
|---|---|---|---|
| 74308 | 3/1983 | European Pat. Off. | 273/153 S |
| 2088728 | 6/1982 | United Kingdom | 273/153 S |

*Primary Examiner*—William H. Grieb

*Attorney, Agent, or Firm*—Rogers, Howell & Haferkamp

[57] ABSTRACT

A spherical mechanical puzzle is comprised of a plurality of separately identifiable puzzle pieces that are hand manipulated over tracks formed in a spherical base member of the puzzle. Three continuous and mutually perpendicular equatorial tracks are formed in the surface of the puzzle base member dividing the base member into eight separate surface sections, each surface section having a different color. The plurality of puzzle pieces are mounted on the three tracks for sliding movement along the tracks, and each of the puzzle pieces is divided into four segments or two segments having identifying colors that correspond to the colors of the base member surface sections. The mechanical puzzle is solved by hand manipulating the puzzle pieces over the three tracks to positions on the tracks where each of the puzzle pieces is positioned adjacent surface sections having the same colors as the puzzle pieces.

19 Claims, 2 Drawing Sheets

SPHERICAL MECHANICAL PUZZLE

BACKGROUND OF THE INVENTION (1) Field of the Invention

The present invention relates to a spherical mechanical puzzle comprised of a plurality of separately identifiable puzzle pieces that are hand manipulated over tracks formed in a spherical base of the puzzle. In particular, the present invention relates to a spherical mechanical puzzle having a spherical base with three continuous equatorial tracks formed in the surface of the base. The three equatorial tracks are arranged perpendicular to each other and divide the base surface into eight separate surface sections, each surface section having an identifying color. A plurality of puzzle pieces are mounted on the three tracks for sliding movement along the tracks, and each of the puzzle pieces of the plurality have identifying colors. The mechanical puzzle is solved by arranging all of the puzzle pieces in positions on the three equatorial tracks where each of the puzzle pieces is positioned adjacent surface sections having the same colors as the puzzle pieces.

(2) Description of the Related Art

Hand manipulated puzzles having pluralities of pieces mounted for movement on a base of the puzzle to arrange the pieces into a desired array are known in the art. The popularity of these types of puzzles is attributable to their portability that enables individuals to carry the puzzles with them and work on their solutions whenever they have idle time. Their popularity is also attributable to the fact that many of these types of puzzles do not have a single solution, but appear to have a variety of different solutions, obtainable by manipulating the puzzle pieces through different series of steps.

A common disadvantage often encountered in prior art mechanical puzzles is that, although they may initially present a challenge to an individual, after successfully solving the puzzle several times the puzzle's solution becomes less and less difficult to the puzzle solver.

Therefore, it would be desirable to produce a puzzle having a variety of solutions obtainable through performing a variety of different series of steps, where several of the puzzle solutions have varying levels of difficulty so that the puzzle solver is always presented with a challenge by the puzzle even after mastering the puzzle solutions of less difficulty.

SUMMARY OF THE INVENTION

The spherical mechanical puzzle of the present invention is basically comprised of a spherical base having three continuous equatorial tracks formed in the surface of the base. The three equatorial tracks are arranged perpendicular to each other and divide the base surface into eight surface sections of equal areas. Each of the eight surface sections is given an identifying characteristic such as an identifying surface color. In the preferred embodiment of the invention, each of the eight surface sections is given a different identifying color.

A plurality of square puzzle pieces are mounted for sliding movement in each of the three equatorial tracks formed in the puzzle base. The plurality of puzzle pieces are arranged side-by-side in the three tracks so that no lengths of the three tracks are left vacant. Six of the plurality of puzzle pieces have top surfaces divided into quadrants, with each of the quadrants being given an identifying color. The colors of the quadrants correspond to the colors of four of the eight surface areas of the puzzle base. The remainder of the puzzle pieces have top surfaces divided into two sections, with each of the sections being colored a different color. The color of each puzzle piece section corresponds to the color of one of the eight surface area sections of the spherical base.

The puzzle is solved by first scrambling the plurality of puzzle pieces over the three equatorial tracks of the base, and then arranging the plurality of puzzle pieces in the three equatorial tracks so that the colored quadrants or sections of the puzzle pieces are arranged adjacent to the same colored surface areas of the spherical base. The six puzzle pieces having surfaces divided into quadrants are arranged at the six equatorial track intersections in orientations where the colors of the puzzle piece quadrants correspond to the colors of the base surface sections adjacent the puzzle piece quadrants. In a variant embodiment of the invention having an easier solution, each of the six puzzle pieces that are to be positioned at the intersections of the tracks are given neutral colors that do not correspond to any of the base surface sections. These puzzle pieces are positioned at the track intersections in any orientation. The remaining puzzle pieces having two sections of different colors are arranged in positions on the three equatorial tracks where their colored sections are positioned adjacent the surface area sections of the base having the same color.

To increase the difficulty of solving the puzzle, the puzzle pieces having surfaces divided into two sections of different colors are also provided with markings that correspond to markings provided on the eight surface sections of the puzzle base. The more difficult solution of the puzzle requires positioning the puzzle pieces having surface sections of two different colors between the two surface sections of the base having colors corresponding to the colors of the puzzle pieces, and also requires positioning the puzzle pieces in a predetermined order along the equatorial tracks defined by matching the markings on the individual puzzle pieces with the markings provided on the surface sections of the base.

In a variation of this embodiment of the invention having the same level of difficulty, the surfaces of the puzzle pieces are provided with uneven color divisions in lieu of the surface markings. In solving the puzzle, not only is it necessary to arrange the plurality of puzzle pieces so that their color divisions are next adjacent the surface area sections of the base having the same color, but the individual puzzle pieces must be arranged in a predetermined order along the equatorial tracks so that the color divisions of the pieces form a continuous pattern over the plurality of puzzle pieces arranged on the tracks.

The spherical body of the mechanical puzzle is molded as a single unit, or a pair of semi-circular half units that are secured together in assembling the puzzle. The three equatorial tracks are molded into the surface of the puzzle base.

Each of the puzzle pieces has an integral stem centered on its underside. A cap is formed on the distal end of the stem. The cap is pressed through the intersection of two of the equatorial tracks on the puzzle base and snaps into the tracks to allow free sliding movement of the puzzle piece in any direction along any of the three tracks.

The spherical mechanical puzzle of the present invention provides a manually manipulated puzzle having a variety of solutions of differing levels of difficulty. The puzzle has a simplified construction and is constructed from a minimum number of parts, is inexpensive to manufacture, and is easily assembled.

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

Figure 1:
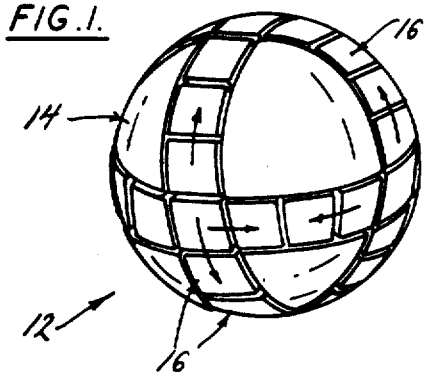
FIG. 1 is a perspective view of the spherical mechanical puzzle of the present invention.

The spherical mechanical puzzle 12 of the present invention is shown in FIG. 1 of the drawing figures. The primary component parts of the mechanical puzzle 12 are a spherical base member 14 and a plurality of puzzle pieces 16 mounted for movement on the base member. In the preferred embodiment, the puzzle base member 14 and puzzle pieces 16 are molded of plastic or other similar material. The base member preferably is constructed of two cup-shaped half sphere members 18, 22, but may also be constructed as a solid sphere.

Three equatorial tracks 24, 26, 28 are molded in the exterior surface of the base member 14. Each of the three tracks is circular, and the three tracks are positioned in three mutually perpendicular phantom planes (not shown) that bisect the sphere. The three tracks extend around the surface of the base member 14 and intersect each other at six locations on the base member, dividing the exterior surface of the base member into eight separate surface sections 32, 34, 36, 38, 42, 44, 46, 48. Each of the eight separate surface sections has substantially the same surface area, and each has a different identifying characteristics such as a different surface color. In variant embodiments of the invention with less difficult solutions, the eight separate surface sections have only four different identifying colors or two different colors. Other identifying characteristics such as different surface textures or different surface markings may be employed in lieu of the different surface colors of the sections.

Figure 6:
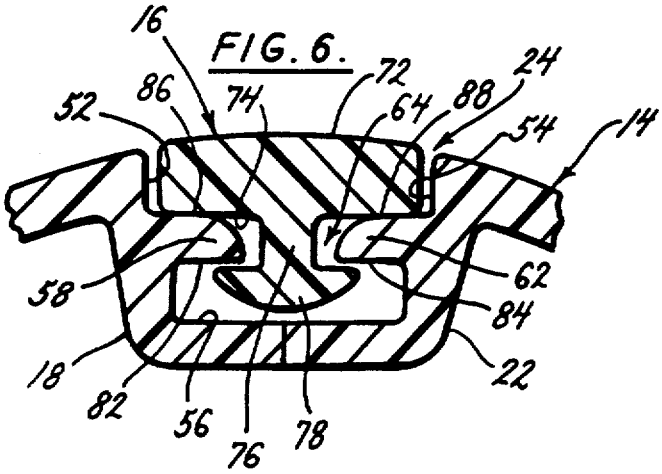
FIG. 6 is a segmented elevation view, in section, showing the connection between one of the equatorial tracks of the puzzle and one of the puzzle pieces.

As is best seen in FIG. 6, each of the three equatorial tracks 24, 26, 28 is formed as a recessed groove in the spherical base member 14. Each of the tracks includes a pair of mutually opposed side walls 52, 54 that extend into the base member 14 from the exterior surface of the base member, and a bottom wall 56 connected between the bottom edges of the track side walls. Mutually opposed flanges 58, 62 extend toward each other from the side walls 52, 54 of the tracks. The flanges stop just short of each other, forming a slot 64 between the flanges.

Figure 5:
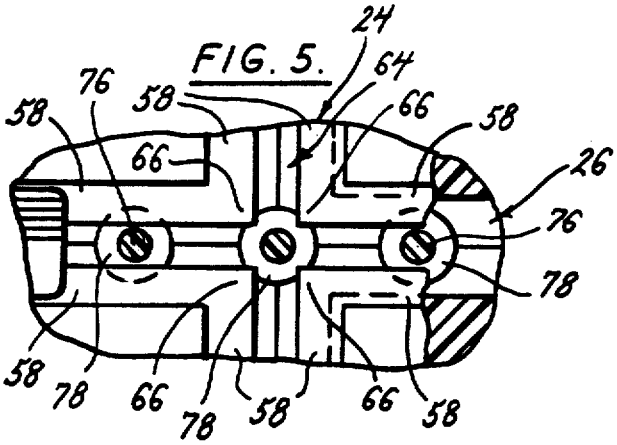
FIG. 5 is a segmented view, partially in section, showing the intersection of two equatorial tracks of the mechanical puzzle.

At each intersection of two of the three equatorial tracks, the flanges of one track meet at corners 66 with the flanges of the other intersecting track. This is best seen in FIG. 5 of the drawing figures. The slots 64 between opposed flanges 58 also intersect each other at the intersections of the tracks.

Each of the plurality of puzzle pieces 16 is basically a square puzzle piece having a top surface 72 and a bottom surface 74 (see FIG. 6). A mushroom-shaped stem or button having a shank 76 and a cap 78 extends from the center of the bottom surface 74 of each puzzle piece 16. The plurality of puzzle pieces 16 are assembled to the equatorial tracks 24, 26, 28 of the base member 14 by pressing the cap 78 of each puzzle piece stem through the intersection of the slots 64 of two of the equatorial tracks. The cap 78 deforms slightly as it is inserted through the intersection of the slots 64, and returns to its original configuration when inserted below the opposed flanges 58, 62 of the intersecting tracks. As is best seen in FIG. 6, with the puzzle piece stem cap 78 inserted below the opposed flanges 58, 62 of the equatorial tracks, the cap 78 engages the undersides 82, 84 of the opposed flanges 58, 62 while the puzzle piece bottom surface 74 slides over the top surfaces 86, 88 of the opposed flanges, thereby mounting each puzzle piece 16 for sliding movement in the equatorial tracks 24, 26, 28 of the base member 14.

Figure 2:
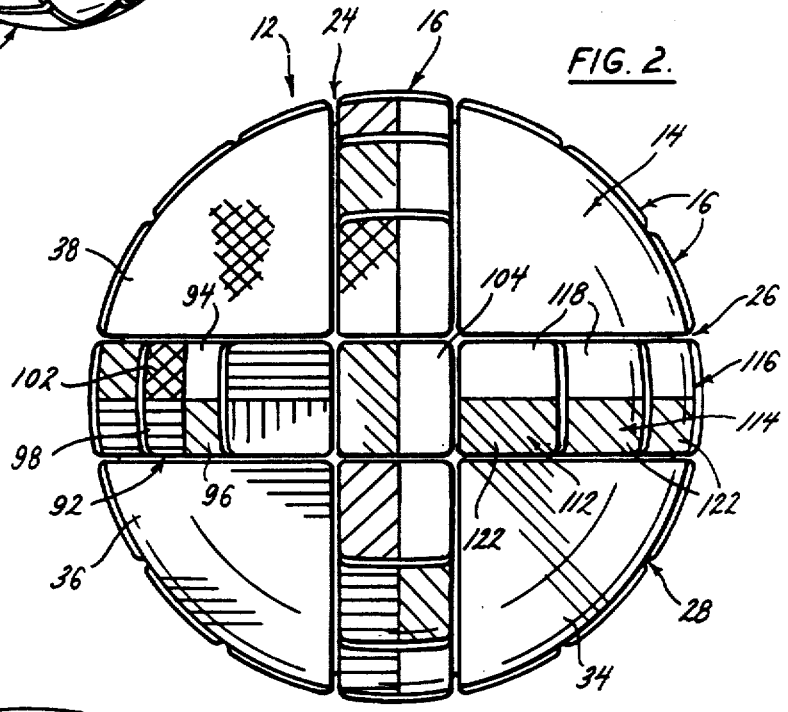
FIG. 2 is a front elevation view of the spherical mechanical puzzle of the present invention.
Figure 3:
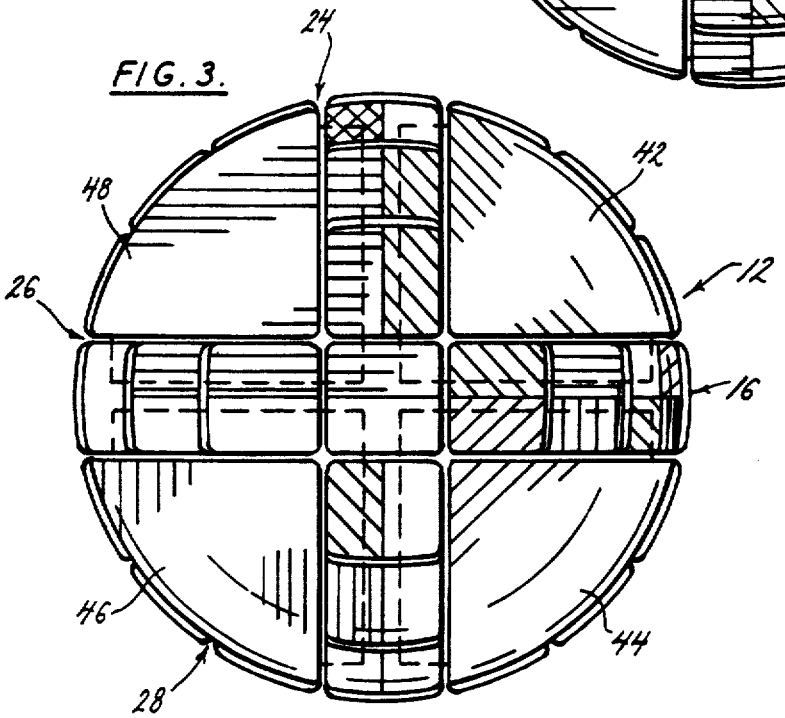
FIG. 3 is a back elevation view of the spherical mechanical puzzle of the invention.

As seen in FIGS. 1–3, each of the plurality of puzzle pieces 16 are positioned side-by-side in the three equatorial tracks 24, 26, 28 so that no lengths of the three tracks are left exposed between the puzzle pieces. Each ring of puzzle pieces mounted on one of the three equatorial tracks may be rotated in either direction around the track, changing the positions of the puzzle pieces on the base member 14. By selectively rotating the rings of puzzle pieces around the three equatorial tracks, any puzzle piece of the plurality of pieces 16 may be moved to any particular position on the three equatorial tracks 24, 26, 28.

The particular orientation of any puzzle piece 16 may also be changed by moving it around the three equatorial tracks. For example, moving a particular puzzle piece 16 from one equatorial track 24 to the first intersection of a second equatorial track 26, and then moving the particular puzzle piece along the second equatorial track 26 to the first intersection with the third equatorial track 28, and then moving the same puzzle piece along the third equatorial track 28 to the intersection with the first equatorial track 24 will rotate the particular puzzle piece one quarter turn from its original orientation relative to the first equatorial track.

Each of the plurality of puzzle pieces 16 has an identifying characteristic or designation on the top surface 72 of the puzzle piece. In the preferred embodiment of the invention, the identifying characteristic of the plurality of puzzle pieces 16 is the particular coloring of the top surface 72 of the puzzle pieces. Other identifying characteristics such as surface textures or markings may also be employed in lieu of the surface colorings of the puzzle pieces.

In the preferred embodiment of the invention shown in the drawing figures, a total of forty-two puzzle pieces 16 are mounted for sliding movement in the three equatorial tracks 24, 26, 28 on the base member 14. The total number of puzzle pieces may be varied without departing from the scope of the invention. Six of the forty-two puzzle pieces 16 have surfaces 72 divided into separate quadrant segments, with each of the four separate segments being given a color designation that matches the color designation of one of the sphere surface sections 32, 34, 36, 38, 42, 44, 46, 48. One of these six puzzle pieces 92 is shown in FIG. 2. This puzzle piece 92 has a top surface that is divided into four separate quadrants 94, 96, 98, 102, having color designations that match four of the separate sphere surface sections 32, 34, 36, 38 of the puzzle base member 14. In solving the puzzle, the puzzle piece 92 must be positioned at the intersection of the equatorial tracks 24, 26 where another puzzle piece 104 is currently positioned. In this position of the puzzle piece 92, one quadrant 94 of the puzzle piece will match up with one surface section 32 of the base member, a second quadrant 96 of the puzzle piece will match up with a second surface section 34 of the base member, a third quadrant 98 of the puzzle piece will match up with a third surface section 36 of the base member, and a fourth quadrant 102 of the puzzle piece will match up with a fourth surface section 38 of the base member. The plurality of puzzle pieces 16 includes five other puzzle pieces, in addition to the puzzle piece 92 shown, having top surfaces 72 divided into quadrants with each of the quadrants having a different color designation matching a color designation of one of the eight sphere surface sections 32, 34, 36, 38, 42, 44, 46, 48. In solving the puzzle, each of these six puzzle pieces having top surfaces divided into four differently colored quadrants must be positioned at an intersection of the equatorial tracks 24, 26, 28 in orientations where the color designations of the four quadrants match up with the color designations of the four sphere surface sections adjacent the equatorial track intersection. This does not change whether the base surface sections of the puzzle embodiment have eight, four, or two different color designations.

In a variant embodiment of the invention, six puzzle pieces are given a neutral color or a color different from all the other puzzle pieces and the base member surface sections. These puzzle pieces are also arranged at the track intersections when solving the puzzle, but because they have no colored quadrants to match with the base surface sections, they can be positioned at the track intersections in any orientation. It should be clear that this embodiment of the invention has a less difficult solution than the preferred embodiment of the invention.

The remainder of the forty-two total puzzle pieces 16, apart from the six puzzle pieces having top surfaces divided into quadrants, have top surfaces divided into two segments with each of the two segments having a different color designation. Three puzzle pieces 112, 114, 116 shown in FIG. 2 are examples of these types of puzzle pieces. As can be seen in FIG. 2, each of these three puzzle pieces 112, 114, 116 have a top surface divided into two different color segments 118, 122. In solving the puzzle, the puzzle pieces of the plurality of puzzle pieces having two separate surface segments of different color designations must be positioned on the equatorial tracks 24, 26, 28 in positions between the base member surface sections 32, 34, 36, 38, 42, 44, 46, 48 having the same color designations as the puzzle pieces. The three puzzle pieces 112, 114, 116 shown in FIG. 2 are positioned on the equatorial ring 26 in their proper positions for solving the puzzle. In the position of the three puzzle pieces 112, 114, 116 shown, their separate segments having different color designations 118, 122 are positioned adjacent the base member surface sections 32, 34 having the same color designations. In solving the puzzle, all the puzzle pieces having two surface segments of different color designations must be manipulated over the three equatorial rings 24, 26, 28 of the puzzle to positions between the base member surface sections 32, 34, 36, 38, 42, 44, 46, 48 having the same color designations as the puzzle pieces. This does not change whether the base surface sections have eight, four, or two different color designations.

Reiterating, the puzzle is solved by first scrambling the plurality of puzzle pieces 16 over the three equatorial tracks 24, 26, 28 of the base member 14, and then arranging the plurality of puzzle pieces in the three equatorial tracks so that the colored quadrants or segments of the puzzle pieces are arranged adjacent to the same colored surface sections 32, 34, 36, 38, 42, 44, 46, 48 of the base member. The six puzzle pieces having surfaces divided into quadrants, with each of the quadrants having a different color designation, are arranged at the six intersections of the equatorial tracks in positions where the colors of the puzzle piece quadrants correspond to or are next adjacent to the base member surface sections having the same color designations as the quadrants. The remaining thirty-six puzzle pieces 16 having two surface segments of different colors are arranged on the three equatorial tracks 24, 26, 28 in positions where their colored segments are positioned next adjacent to base member surface sections 32, 34, 36, 38, 42, 44, 46, 48 having the same color designations.

Figure 4:
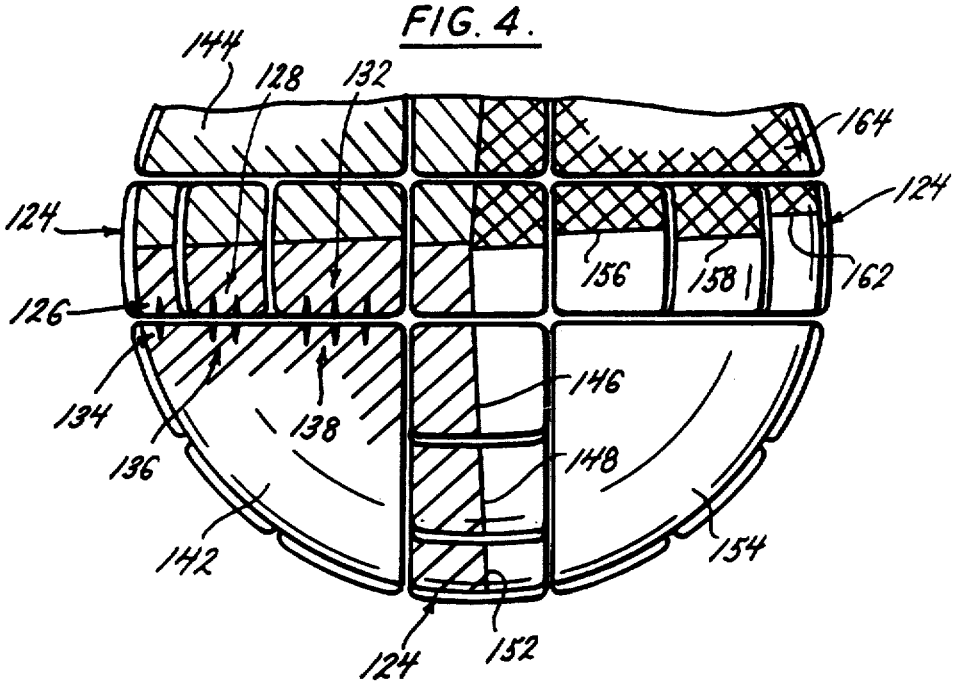
FIG. 4 is a segmented elevation view showing a variation of the puzzle pieces.

FIG. 4 shows a variation of the puzzle that provides a more difficult solution. In this version of the puzzle, the puzzle pieces 124 having top surfaces divided into two segments of different colors are also provided with some fashion of markings. The markings determine a particular order that the puzzle pieces are to be arranged into on the equatorial tracks of the puzzle base member in solving the puzzle. In one embodiment shown in FIG. 4, the puzzle pieces 124 having surfaces divided into two segments of different colors are also provided with markings 126, 128, 132 that correspond to like markings 134, 136, 138 provided on the base member surface section 142 adjacent which the puzzle pieces are to be arranged in solving the puzzle. Although only three puzzle pieces and one surface section are shown having the markings, it should be understood that all the two segment puzzle pieces and all the surface sections of the base member are provided with the markings. As seen in FIG. 4, in order to properly solve the puzzle, not only are the puzzle pieces 124 to be arranged in positions on the equatorial tracks adjacent to the base member surface sections 142, 144 with color designations corresponding to the color designations of the puzzle pieces 124, but the puzzle pieces are also to be positioned in a predetermined order so that the markings 126, 128, 132 of the puzzle pieces match up with the markings 134, 136, 138 on the adjacent base member surface section 142.

In a variant embodiment of the invention that provides a solution to the puzzle having the same difficulty as the embodiment just described, the different colored surface designations of the puzzle pieces 124 are separated by an inclined line segment 146, 148, 152 that, when the puzzle pieces are arranged in their proper order on the equatorial tracks of the puzzle base member, form a straight line separating the separate surface color designations of the puzzle pieces. This embodiment of the invention is also shown in FIG. 4. As seen in FIG. 4, when the puzzle pieces having surface segments divided by inclined lines 146, 148, 152 are arranged in their proper order on an equatorial track between the correct base member surface sections 142, 154, the lines 146, 148, 152 of the adjacent puzzle pieces 124 line up in a straight line. To better explain this solution of the puzzle, FIG. 4 shows additional puzzle pieces 124 having lines 156, 158, 162 separating the different colored segments of the puzzle pieces, the additional puzzle pieces being arranged in the wrong order on one of the equatorial tracks of the puzzle base member. As seen in FIG. 4, the puzzle pieces with the inclined lines 156, 158, 162 are properly positioned between the base member surface sections 154, 164 having color designations that correspond to the color designations of the two surface segments of the puzzle pieces 124, but are arranged in the wrong order on the equatorial track as indicated by the discontinuous arrangement of the lines 156, 158, 162. To properly position these puzzle pieces, they must be rearranged in order on the equatorial track so that the lines 156, 158, 162 extend together in a straight line such as that shown by the lines 146, 148, 152 of the properly positioned puzzle pieces. Although a straight line is shown delineating the colored segments of the puzzle pieces, a curved line may also be used.

While the present invention has been described by reference to a specific embodiment, it should be understood that modifications and variations of the invention may be constructed without departing from the scope of the invention defined in the following claims.

I claim:

1. A mechanical puzzle comprising:

a base having a base surface;

a plurality of separate, continuous tracks formed in the base surface, the plurality of tracks dividing the base surface into a plurality of separate surface sections, each of the surface sections having identifying designations;

a plurality of puzzle pieces mounted on the plurality of tracks for movement along the plurality of tracks, each of the puzzle pieces having a surface and each surface having a designation, the designations of the puzzle piece surfaces matching at least one of the designations of the base surface sections.

2. The puzzle of claim 1, wherein:

the plurality of tracks intersect each other, enabling the movement of each of the plurality of puzzle pieces over the plurality of tracks.

3. The puzzle of claim 1, wherein:

the base surface is a spherical surface, and the plurality of tracks are each equatorial tracks.

4. The puzzle of claim 3, wherein:

the plurality of tracks includes a first, a second and a third track, each of the first, second and third tracks has a continuous centerline positioned in a first, second or third phantom plane, respectively, the first, second and third phantom planes being mutually perpendicular.

5. The puzzle of claim 1, wherein:

each of the designations of the base surface sections are color designations, the color of each base surface section being different.

6. The puzzle of claim 5, wherein:

each of the designations of the puzzle piece surfaces are color designations, the color designations of each of the puzzle piece surfaces matching at least one of the color designations of the base surface sections.

7. The puzzle of claim 6, wherein:

six puzzle pieces of the plurality of puzzle pieces each have surface color designations that match four of the color designations of the plurality of base surfaces, and the plurality of puzzle pieces other than the six puzzle pieces each have surface color designations that match two of the color designations of the plurality of base surfaces.

8. The puzzle of claim 3, wherein:

each of the tracks is formed as a recessed groove having a bottom wall and opposed side walls, the walls are all recessed below the base surface, and a flange extends laterally into the groove from a radially intermediate portion of each side wall.

9. The puzzle of claim 8, wherein:

the flanges of each groove are recessed below the base surface, the plurality of puzzle pieces rest on and slide over the flanges of each groove, and the plurality of puzzle pieces are inset in each groove with the surfaces of each puzzle piece being substantially flush with the base surface.

10. The puzzle of claim 9, wherein:

each of the plurality of puzzle pieces includes a mushroom shaped button projecting from an opposite side of the puzzle piece from the puzzle piece surface, each button has a stem and a cap formed integrally with the puzzle piece, each cap is inserted between and engages an opposed pair of flanges of one of the track grooves to mount the puzzle piece for movement on the tracks.

11. The puzzle of claim 6, wherein:

the designations of the puzzle piece surfaces are markings provided on the puzzle piece surfaces that match with markings on at least one of the base surface sections.

12. A mechanical puzzle comprising:

a base having a spherical surface;

a plurality of tracks formed in the base surface, the tracks dividing the base surface into a plurality of separate surface sections, each of the surface sections having an identifying characteristic;

a plurality of puzzle pieces mounted on the plurality of tracks for movement along the plurality of tracks, each puzzle piece having a surface divided into separate surface segments, each of the surface segments having an identifying characteristic that is substantially the same as an identifying characteristic of one of the plurality of surface sections of the base surface.

13. The puzzle of claim 12, wherein:

the plurality of puzzle pieces includes at least six puzzle pieces, each puzzle piece of the six puzzle pieces having a surface divided into four separate surface segments, each of the four separate surface segments having an identifying characteristic that is substantially the same as an identifying characteristic of one of the plurality of surface sections of the base surface.

14. The puzzle of claim 13, wherein:

the plurality of puzzle pieces includes additional puzzle pieces other than the six puzzle pieces, the additional puzzle pieces each have a surface divided into two separate surface segments, each of the two separate surface segments of the additional puzzle pieces have an identifying characteristic that is substantially the same as an identifying characteristic of one of the plurality of surface sections of the base surface.

15. The puzzle of claim 14, wherein:

each of the identifying characteristics of the plurality of base surface sections is an identifying color of each of the base surface sections, the color of each base surface section being different, and each of the identifying characteristics of the separate surface segments of the plurality of puzzle pieces is an identifying color of the puzzle piece surface segments, the color of each puzzle piece surface segment being the same as a color of one of the base surface sections.

16. The puzzle of claim 12, wherein:

the plurality of tracks includes three equatorial tracks that intersect each other and divide the base surface into eight separate surface sections of substantially equal surface areas.

17. The puzzle of claim 12, wherein:

the plurality of puzzle pieces are successively positioned, side-by-side, over each track of the plurality of tracks.

18. The puzzle of claim 14, wherein:

the identifying characteristics of the plurality of base surface sections is a series of markings on each surface section, and each of the identifying characteristics of the separate surface segments of the plurality of puzzle pieces is an identifying marking of the puzzle piece surface segment, the marking of each puzzle piece surface segment being the same as a marking in a series of markings of one of the base surface sections.

19. A mechanical puzzle comprising:

a base having a spherical surface;

three equatorial tracks formed in the surface of the base, the three equatorial tracks being positioned in three mutually perpendicular phantom planes;

the three tracks bordering eight surface sections of the base surface, the surface sections having substantially equal surface areas and each surface section having an identifying characteristic, the identifying characteristics of the surface sections each being different;

a plurality of separate puzzle pieces movably mounted on the three tracks, the plurality of puzzle pieces being successively positioned, side-by-side, on the tracks, six of the puzzle pieces each having a surface divided into four quadrant segments, each of the four quadrant segments of the six puzzle pieces having an identifying characteristic that is substantially the same as the identifying characteristic of one of the eight surface sections, and remaining puzzle pieces of the plurality of puzzle pieces apart from the six puzzle pieces each having a surface divided into two surface segments, each of the two surface segments of the remaining puzzle piece shaving an identifying characteristic that is substantially the same as the identifying characteristic of one of the eight surface sections.

* * * * *